US010323652B2

(12) United States Patent
Walker

(10) Patent No.: US 10,323,652 B2
(45) **Date of Patent: *Jun. 18, 2019**

(54) PUMP INTAKE DEVICE

(71) Applicant: Weir Minerals Australia Ltd., Artarmon NSW (AU)

(72) Inventor: Craig Ian Walker, Warriewood (AU)

(73) Assignee: Weir Minerals Australia Ltd. (AU)

( * ) Notice: Subject to any disclaimer, the term of this patent is extended or adjusted under 35 U.S.C. 154(b) by 348 days.

This patent is subject to a terminal disclaimer.

(21) Appl. No.: 15/243,019

(22) Filed: Aug. 22, 2016

(65) Prior Publication Data

US 2017/0045057 A1 Feb. 16, 2017

Related U.S. Application Data

(63) Continuation of application No. 13/582,976, filed as application No. PCT/AU2011/000225 on Mar. 1, 2011, now Pat. No. 9,422,829.

(30) Foreign Application Priority Data

Mar. 5, 2010 (AU) ..... 2010900943
Sep. 14, 2010 (AU) ..... 2010904140

(51) Int. Cl.
*F04D 29/42* (2006.01)
*F04D 29/44* (2006.01)
(Continued)

(52) U.S. Cl.
CPC ..... *F04D 29/4273* (2013.01); *F01D 25/24* (2013.01); *F04D 7/04* (2013.01);
(Continued)

(58) Field of Classification Search
CPC ... F01D 25/24; F04D 7/02; F04D 7/04; F04D 29/42; F04D 29/426; F04D 29/4273;
(Continued)

(56) References Cited

U.S. PATENT DOCUMENTS 1,608,547 A * 11/1926 O'Fallon ..... F04D 29/4273 415/189
3,620,642 A 11/1971 Studebaker et al.
(Continued)

FOREIGN PATENT DOCUMENTS

CN 101555886 A 10/2009
DE 102007048019 A1 4/2009
(Continued)

*Primary Examiner* — Justin D Seabe
*Assistant Examiner* — Alexander A White
(74) *Attorney, Agent, or Firm* — Morriss O'Bryant Compagni

(57) ABSTRACT

A pump intake device comprising a main body which includes a side wall section having an inner side and an outer side, an intake section extending from the outer side of the side wall section and an intake passage extending through the intake section, the intake passage having an inner surface and an entry end and an exit end with a central axis extending between the entry and exit ends, a first portion of the inner surface having one or more first guides thereon for directing fluid passing through the intake passage so that in use said fluid leaves the exit end at the first portion with an exit angle which is inclined relative to the central axis.

4 Claims, 9 Drawing Sheets

(51) Int. Cl.

| | |
|---|---|
| ***F04D 7/04*** | (2006.01) |
| ***F01D 25/24*** | (2006.01) |
| ***F04D 29/66*** | (2006.01) |
| *F04D 29/24* | (2006.01) |

(52) U.S. Cl.

CPC ..... *F04D 29/4286* (2013.01); *F04D 29/44* (2013.01); *F04D 29/448* (2013.01); *F04D 29/666* (2013.01); *F04D 29/24* (2013.01); *F05D 2250/51* (2013.01)

(58) Field of Classification Search

CPC .... F04D 29/4286; F04D 29/44; F04D 29/445; F04D 29/448; F04D 29/46; F04D 29/466; F04D 29/528; F04D 29/54; F04D 29/548; F04D 29/56; F04D 29/566; F04D 29/66; F04D 29/666; F04D 29/667; F04D 29/669

USPC ..... 415/74, 151, 159–162, 169.3, 196, 197, 415/198.1–199.6, 208.1, 208.2, 209.1

See application file for complete search history.

(56) References Cited

U.S. PATENT DOCUMENTS

| | | | |
|---|---|---|---|
| 3,977,808 | A | 8/1976 | Schiele et al. |
| 4,637,779 | A | 1/1987 | Sherman et al. |
| 4,802,818 | A | 2/1989 | Wiggins |
| 4,893,986 | A | 1/1990 | Catterfeld et al. |
| 5,947,680 | A | 9/1999 | Harada et al. |
| 6,273,677 | B1 | 8/2001 | Wang et al. |
| 6,431,831 | B1 | 8/2002 | Addie et al. |
| 7,234,914 | B2 | 6/2007 | Usab, Jr. |
| 2004/0096316 | A1 | 5/2004 | Simon et al. |
| 2004/0187475 | A1 | 9/2004 | Usab, Jr. et al. |

FOREIGN PATENT DOCUMENTS

| | | | |
|---|---|---|---|
| GB | 500965 | A | 2/1939 |
| JP | 57140594 | A | 8/1982 |
| UA | 12092 | U | 1/2006 |
| UA | 81286 | C2 | 12/2008 |
| WO | 2006135304 | A1 | 12/2006 |
| WO | 2007004943 | A1 | 1/2007 |

* cited by examiner

PUMP INTAKE DEVICE

CROSS-REFERENCE TO RELATED APPLICATIONS

This application is a continuation application of U.S. Ser. No. 13/582,976, filed Nov. 12, 2012, now issued as U.S. Pat. No. 9,422,829, which claims priority as a national phase entry under 35 U.S.C. § 371 to PCT/AU2011/000225, filed Mar. 1, 2011, which claims priority to Australian Patent Application No. 2010900943, filed Mar. 5, 2010, and also claims priority to Australian Patent Application No. 2010904140, filed Sep. 14, 2010, the entirety of each of which is incorporated by this reference.

TECHNICAL FIELD

This disclosure relates generally to pumps and more particularly, though not exclusively, to centrifugal slurry pumps which are suitable for pumping slurries.

BACKGROUND ART

Centrifugal slurry pumps generally include a pump casing comprising a main casing part and one or more side parts. The pump may also comprise an outer housing which encases the pump casing. In this latter arrangement, the pump casing is configured as a pump liner which is typically formed from hard metals or elastomers. An impeller is mounted for rotation within the casing about a rotation axis. The main casing part has an outer peripheral wall section with an internal surface which may be of volute form, a discharge outlet and an inlet which is at one side of the casing and coaxial with the impeller rotation axis. The impeller typically includes a hub to which a drive shaft is operatively connected and at least one shroud. Pumping vanes are provided on one side of the shroud with discharge passageways between adjacent pumping vanes. In one form of impeller, two shrouds are provided with pumping vanes being disposed therebetween. The pumping vanes include opposed main side faces one of which is a pumping or pressure side face. The pumping vanes further include a leading edge portion in the region of the inlet and a trailing edge portion in the region of the outer peripheral edge of the or each shroud. The leading edge portion is inclined with respect to the inlet at a vane inlet angle.

One of the side parts can define a pump intake. In many applications the pump intake includes a protruding section of entry pipe which is generally arranged so as to be horizontally disposed, also having a lateral plate extending from the periphery of the said entry pipe. The entry pipe and lateral plate piece portion is often referred to as a front liner suction plate or a throatbush.

For slurry pumps handling heterogeneous slurries (with settling particles of typical size 0.5 mm) it is common for there to be a solids concentration gradient weighted towards the bottom of the horizontally-disposed inlet pipe. Because the concentration of solids is greater at the bottom of the pipe due to settling, the velocity of the particles at the bottom of the pipe is reduced relative to that at the top of the pipe. The implications of this skewed velocity and concentration gradient on the optimum design of the impeller are significant. Impeller pumping vanes are usually designed for "shockless" entry of the fluid onto the impeller pumping vanes.

SUMMARY OF THE DISCLOSURE

In a first aspect embodiments are disclosed of a pump intake device comprising a main body which includes a side wall section having an inner side and an outer side, an intake section extending from the outer side of the side wall section and an intake passage extending through the intake section, the intake passage having an inner surface and an entry end and an exit end with a central axis extending between the entry and exit ends, a first portion of the inner surface having one or more first guides thereon for directing fluid passing through the intake passage so that in use said fluid leaves the exit end at the first portion with an exit angle which is inclined relative to the central axis.

In some embodiments, the pump intake device may further include a wear member mountable to the inner side of the side wall section of the main body in a mounted position. The wear member may, in some embodiments, include a side wall and a conduit extending from the side wall, the conduit extending into and forming part of the intake passage when in the mounted position, the first guides being on an inner surface of the conduit. This wear member may be replaceable rather than replacement of the whole main body after a period of use.

In some embodiments, a second portion of the inner surface of the intake passage may have one or more second guides thereon, the second guides configured so that the exit angle is less than the exit angle of the first guides. In certain embodiments the second portion is comprised of an inner surface of said conduit.

In some embodiments, the or each first or second guide is in the form of a vane having a leading edge portion and a trailing edge portion. The trailing edge of the or each vane may for example be at the exit end.

Throughout this specification, the term "exit angle" refers to the angle between a centreline which extends along the main body portion of the guide and a centreline which extends along the trailing edge portion of the guide. In the normal circumstance, the trailing edge portion of the guide is aligned with the central axis of the intake passage of the intake section of the intake device.

In some embodiments, there is a plurality of the first guides in the first portion of the inner surface. In some embodiments there is a plurality of the second guides in the second portion of the inner surface.

In some applications, the central axis may be generally horizontally disposed or extends laterally with respect to an upright axis and in this arrangement the first portion is disposed below the central axis and the second portion is disposed above the central axis.

In certain embodiments, the main body includes a recess in the inner side thereof the wear member being seated within the recess in the mounted position. The recess and the wear member may have complementary inclined peripheral edge portions for properly locating the wear member within the recess.

In some embodiments, the surface of the wear member passage may be arcuate in the axial direction, tapering outwardly in a direction towards the inner side of the main body.

In certain embodiments, the exit angle of the or each guide in the first portion may be predetermined in the range from about 30 angle degrees to about 60 angle degrees, depending on the application. In certain embodiments, the exit angle of the or each guide in the first portion is about 45 angle degrees.

In certain embodiments, the exit angle of the or each guide in the second portion may be predetermined in the range from about 15 angle degrees to about 30 angle degrees. In certain embodiments, the exit angle of the or each guide in the second portion is about 22 angle degrees.

In a second aspect, embodiments are disclosed of a wear member for a pump intake device, the pump intake device comprising a main body which includes a side wall section having an inner side and an outer side, an intake section extending from the outer side of the side wall section and an intake passage extending through the intake section, the intake section having an inner surface, and an entry end and an exit end, with a central axis extending between the entry and exit ends, the wear member comprising a side wall and a conduit extending from said side wall with a passage extending therethrough, a plurality of first guides on an inner surface of a portion of the conduit so that in use said fluid passes through the passage and exits at the first portion at an exit angle which is inclined relative to the central axis.

In certain embodiments, a second portion of the inner surface of the intake passage has one or more second guides thereon, the second guides configured so that the exit angle is less than the exit angle of the first guides. In some embodiments there is a plurality of the first guides in the first portion of the inner surface and a plurality of the second guides in the second portion of the inner surface.

In certain embodiments, the or each first or second guide is in the farm of a vane of the type described earlier.

In a third aspect, embodiments are disclosed of a pump liner assembly for a pump housing, the pump housing comprising an outer casing, the pump liner including a main component receivable within the outer casing in use, and a pump intake device as described above.

In a fourth aspect, embodiments are disclosed of a method of replacing a wear member of a pump intake device, the wear member and the pump intake device being in the form described above, the method including the steps of unfastening the wear member and removing it from the main body.

In a fifth aspect, embodiments are disclosed of a pump apparatus comprising a pump impeller having a plurality of pumping vanes, the impeller being mounted for rotation about a rotation axis, the apparatus further including a pump intake device as described above, the pump intake device being disposed adjacent the impeller pumping vanes.

In a sixth aspect, embodiments are disclosed of a method of redistributing the abrasive wear between a slurry pump impeller and an adjacent slurry pump intake device, wherein the intake device is arranged with guides, in accordance with the first or second aspects hereinabove, the guides located in various different, predetermined designs or configurations and tailored to produce an exit angle of pumped material from the intake device which reduces the wear pattern on the impeller and thereby extends the overall wear life of the said impeller.

In a seventh aspect, embodiments are disclosed of a method of redistributing the abrasive wear between a slurry pump impeller and an adjacent slurry pump intake device, wherein the intake device is arranged with guides in accordance with the first or second aspects hereinabove, the guides located in various different, predetermined designs or configurations and tailored to produce a more even wear pattern on the intake device and thereby extend the overall wear life of the adjacent impeller.

The arrangement is such that, when in use, wear associated with the passage of material (which in one application is a slurry) is distributed between the impeller pumping vanes and the guides which can be referred to as pre-swirl guides. In the known art of slurry pumping, the impeller can tend to wear more quickly than the adjacent pump intake device, so the provision of guides arranged with an appropriate exit angle can redistribute the abrasive wear from the impeller to the pump intake device. The provision of such guides tends to "even up" the wear between the guides and the pumping vanes resulting in an overall reduction in wear.

BRIEF DESCRIPTION OF THE SEVERAL VIEWS OF THE DRAWINGS

Notwithstanding any other forms which may fall within the scope of the methods and apparatus as set forth in the Summary, specific embodiments will now be described, by way of example, and with reference to the accompanying drawings in which.

DETAILED DESCRIPTION OF THE INVENTION

Figure 1:
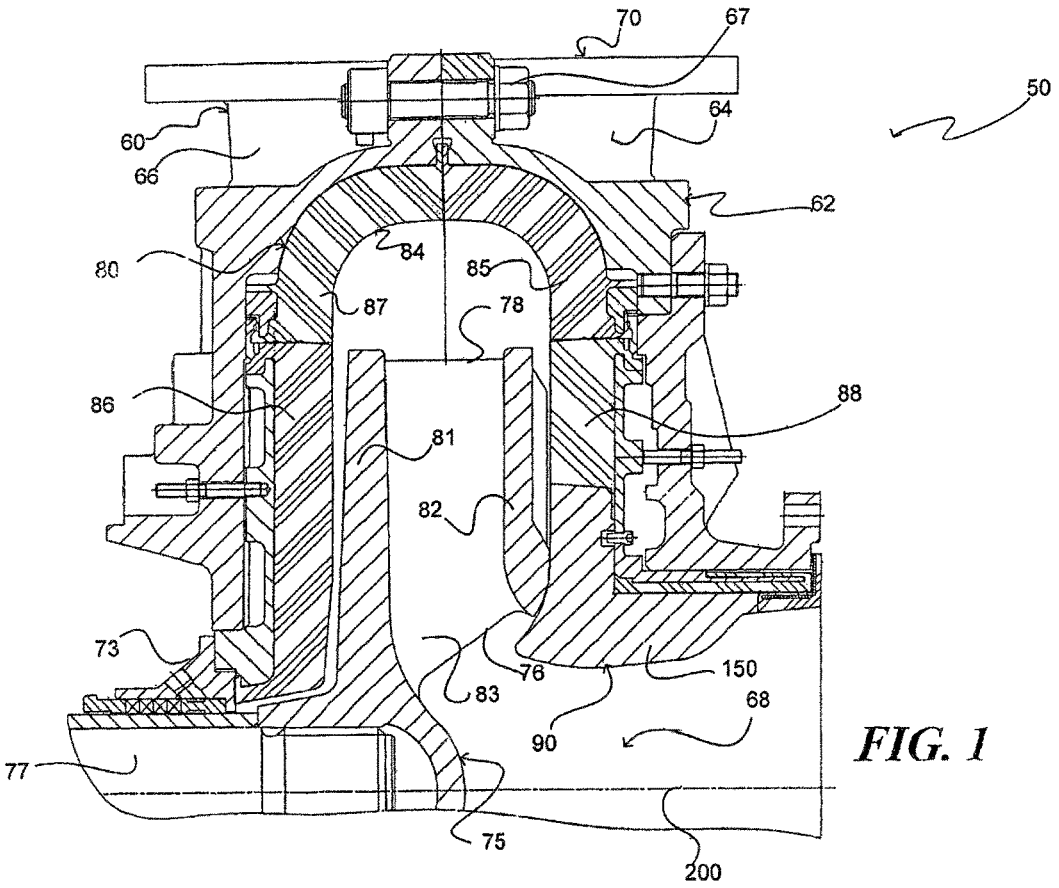
FIG. 1 is an exemplary sectional side elevation of a portion of a pump in accordance with one embodiment.

Referring to FIG. 1 of the drawings, there is illustrated a partial side-sectional view of a portion of a pump 50 comprising a pump housing 60 which is mounted to a pump housing support or pedestal. The pump housing 60 generally comprises an outer casing 62 that is formed from two side casing parts or halves 64, 66 (sometimes also known as the frame plate and the cover plate) which are joined together about the periphery of the two side casings parts 64, 66. The pump housing 50 is formed with an inlet hole 68 and a discharge outlet hole 70 and, when in use in a process plant, the pump is connected by piping to the inlet hole 68 and to the outlet hole 70, for example to facilitate pumping of a mineral slurry.

The pump housing 60 further comprises a pump housing inner liner 80 arranged within the outer casing 62 and which includes a main liner (or volute) 84 and two side liners 86, 88. The side liner (or back liner) 86 is located nearer the rear end of the pump housing 60 and closer to the pedestal and the other side liner (or front liner) 88 is located nearer the opposite, front end of the pump housing 60. The front liner 88 is sometimes referred to as a throatbush.

The two side casing parts 64, 66 of the outer casing 62 are joined together by bolts 67 which are located about the periphery of the casing parts 64, 66 when the pump is assembled for use. In the embodiment shown, the main liner (or volute) 84 is comprised of two separate halves 85, 87 (made of such material as rubber or elastomer) which are assembled within each of the side casing parts 64, 66 and brought together to form a single main liner, although in other arrangements the main liner (or volute) can be made in one-piece, shaped similar to a car tyre (and made of metal material).

When the pump 50 is assembled, the side openings in the main liner 84 are filled by the two side liners 86, 88 to form a continuously-lined chamber disposed within the pump outer casing 62. A seal chamber housing 73 encloses the side liner (or back liner) 86 and is arranged to seal the space between the shaft and the side liner 86 to prevent leakage from the back area of the outer casing 62.

An impeller 75 is positioned within the main liner 84 and is mounted to a drive shaft 77 which has a rotation axis aligned with central pump axis 200. A motor drive (not shown) is normally attached by pulleys to the exposed end of the shaft 77, in the region located behind the pedestal or base. The impeller 75 comprises a back shroud 81 and a front shroud 82, a series of pumping vanes 83 therebetween. Each pumping vane 83 has a leading edge portion 76 and a trailing edge portion 78. The rotation of the impeller 75 causes the fluid (or solid-liquid mixture) being pumped to pass from the pipe which is connected to the inlet hole 68 through the chamber which is defined by the main liner 84 and the side liners 86, 88, and then out of the pump 50 via the outlet hole 70.

Referring to FIGS. 2 to 4, 11 and 12, there is shown side liner part 88 which is in the form of a pump intake device which includes a main body 91, the main body 91 including an annular, disc-shaped side wall 92 having a front face 93 and a rear face 94. The main body 91 also includes an inlet section in the form of a conduit 95 having an intake passage 97 which extends from the front face 93 terminating at a free end portion 96 of the conduit 95. This part of the main body 91 is typically formed from an elastomeric material such as rubber.

A reinforcing or mounting ring 101 is shown fitted or moulded at the front face 93 of the side wall section 92. The mounting ring 101 has an outwardly projecting peripheral, circumferential rim 98. The mounting ring 101 also comprises a grid-like pattern of bars extending radially from a region near the stem of the conduit 95 where it joins the disc-shaped side wall section 92 toward the mounting ring, like the spokes in a bike wheel, with the effect of providing a reinforcement structure to support the main body 91 at the front face 93.

Figure 2:
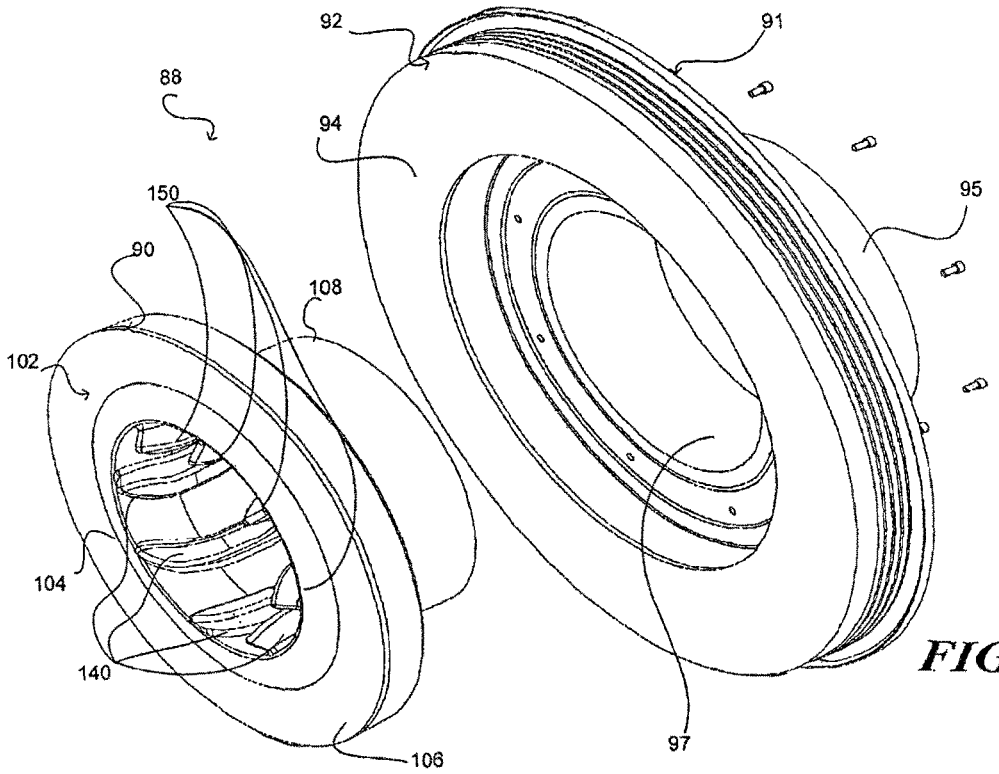
FIG. 2 is a perspective exploded view of a pump intake device viewed from one side and in accordance with one embodiment.
Figure 3:
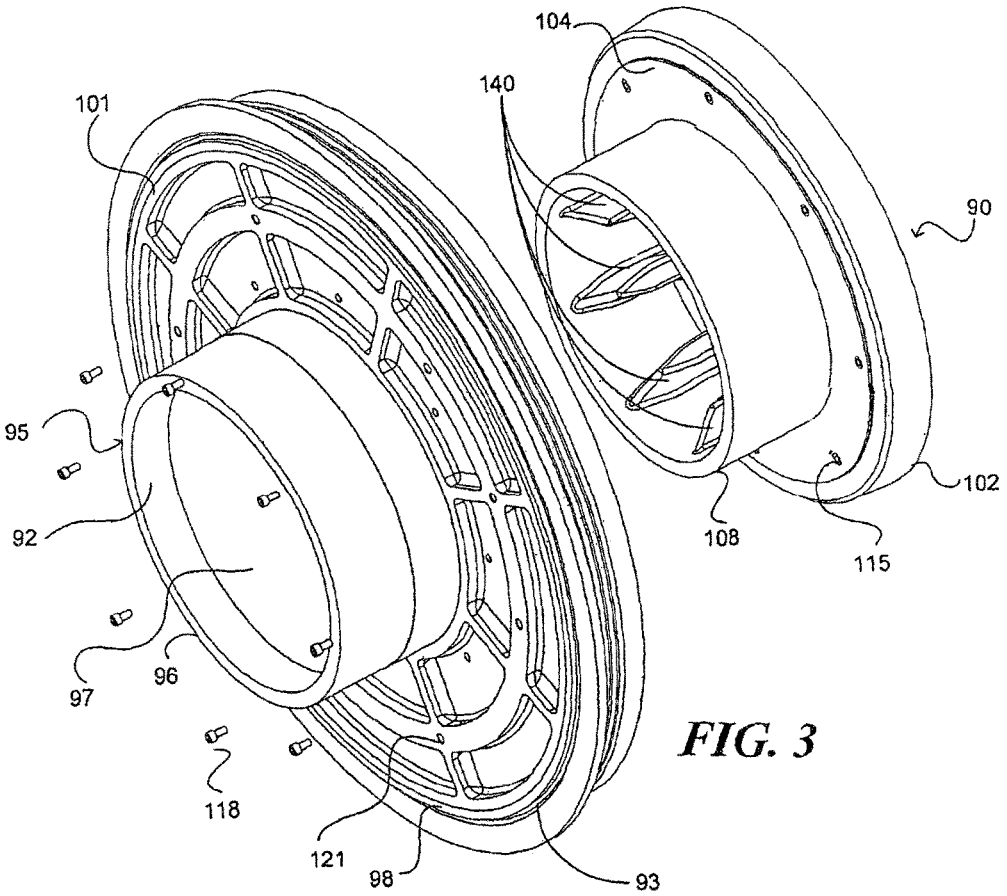
FIG. 3 is a perspective exploded view of the device as shown in FIG. 2 as shown from the other side opposite to the one side.
Figure 4:
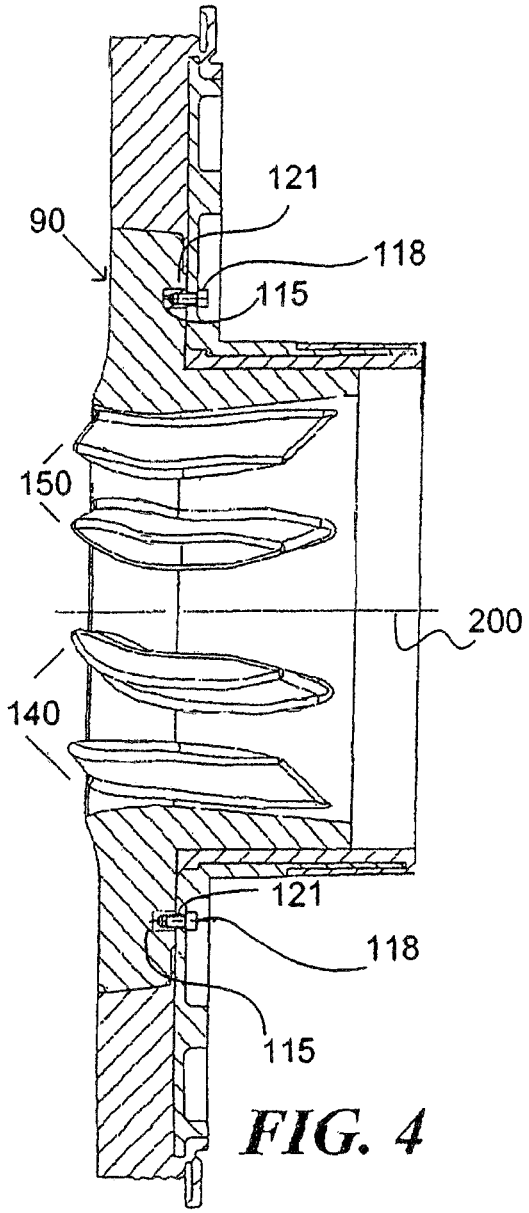
FIG. 4 is a first sectional view of the device as shown in FIGS. 2 and 3.

In the embodiment of FIGS. 2-4, the assembly further includes a wear member 90 which is mountable to the inner side or rear face 94 of the main body 91. The wear member comprises a disc-shaped wear section 102 and a conduit section 108 which extends therefrom so as to form part of, and is in co-axial alignment with the intake passage 97. The wear element 102 has an annular, inner side face 104 and an annular, outer side face 106. The wear element 102 is typically formed from a highly wear resistant material such as for example ceramic, hardened metal, metal alloys, or the like.

Figure 5:
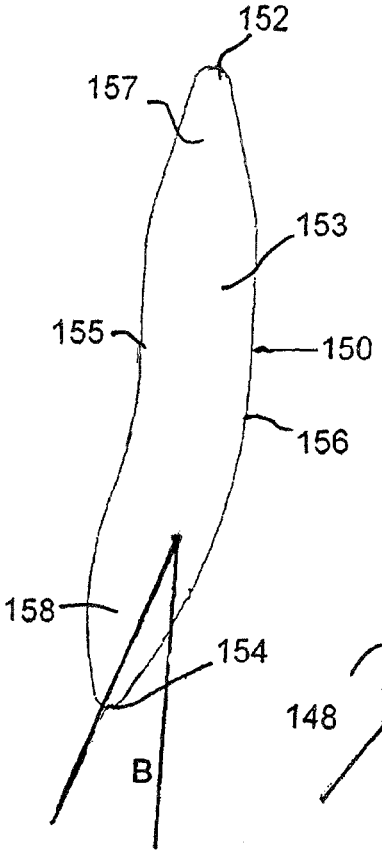
FIGS. 5 and 6 are schematic plan views of the profiles of the vanes which form part of the device shown in FIGS. 2 and 3.
Figure 6:
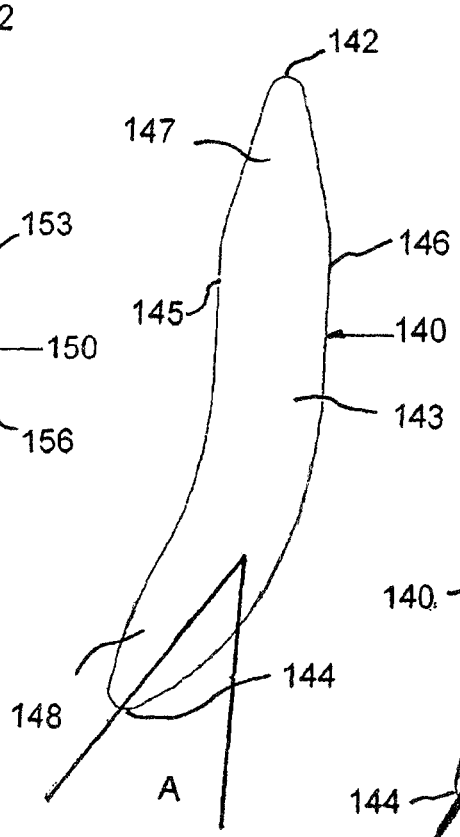
Figure 7:
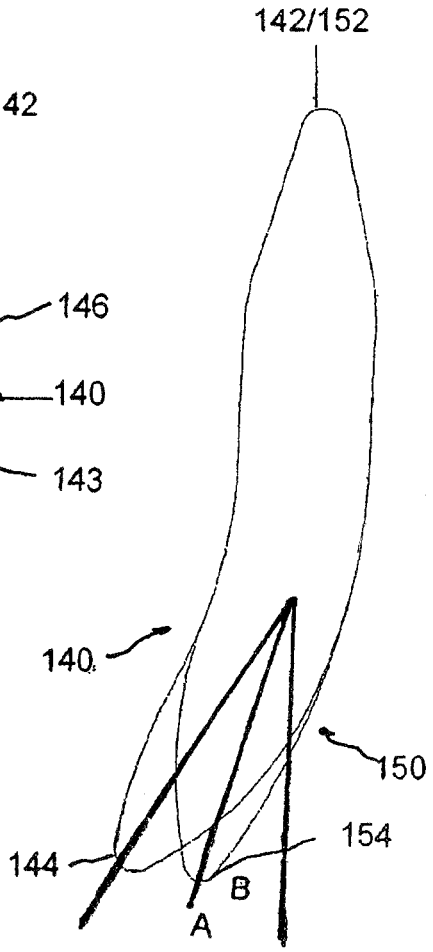
FIG. 7 is a schematic plan view of the profiles shown in FIGS. 5 and 6 overlying one another.
Figure 11:
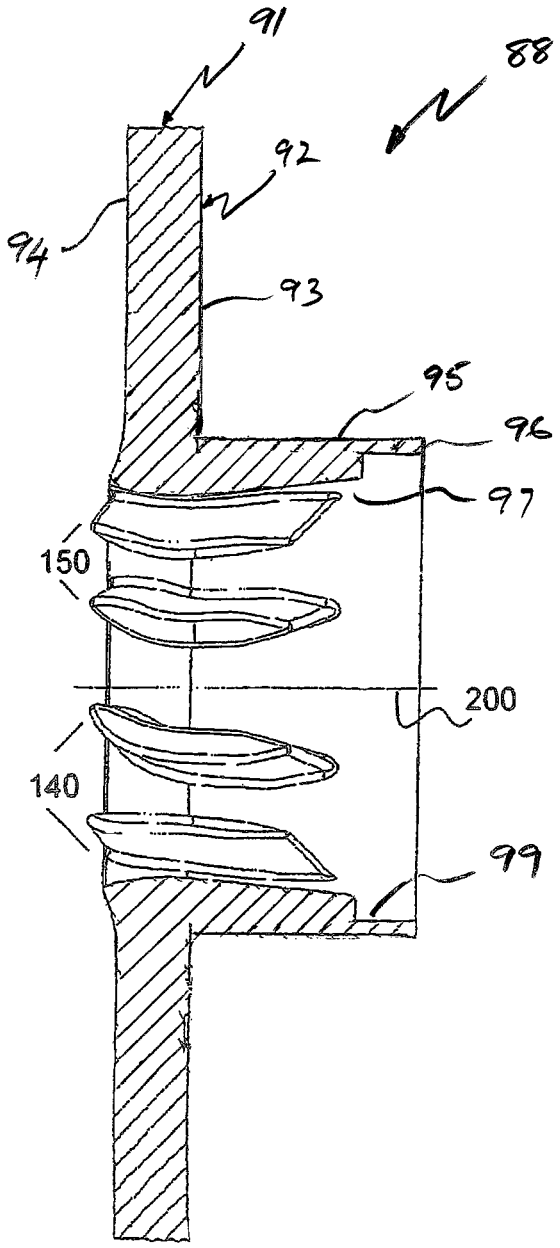
FIG. 11 is a sectional view of another embodiment of the pump intake device.
Figure 12:
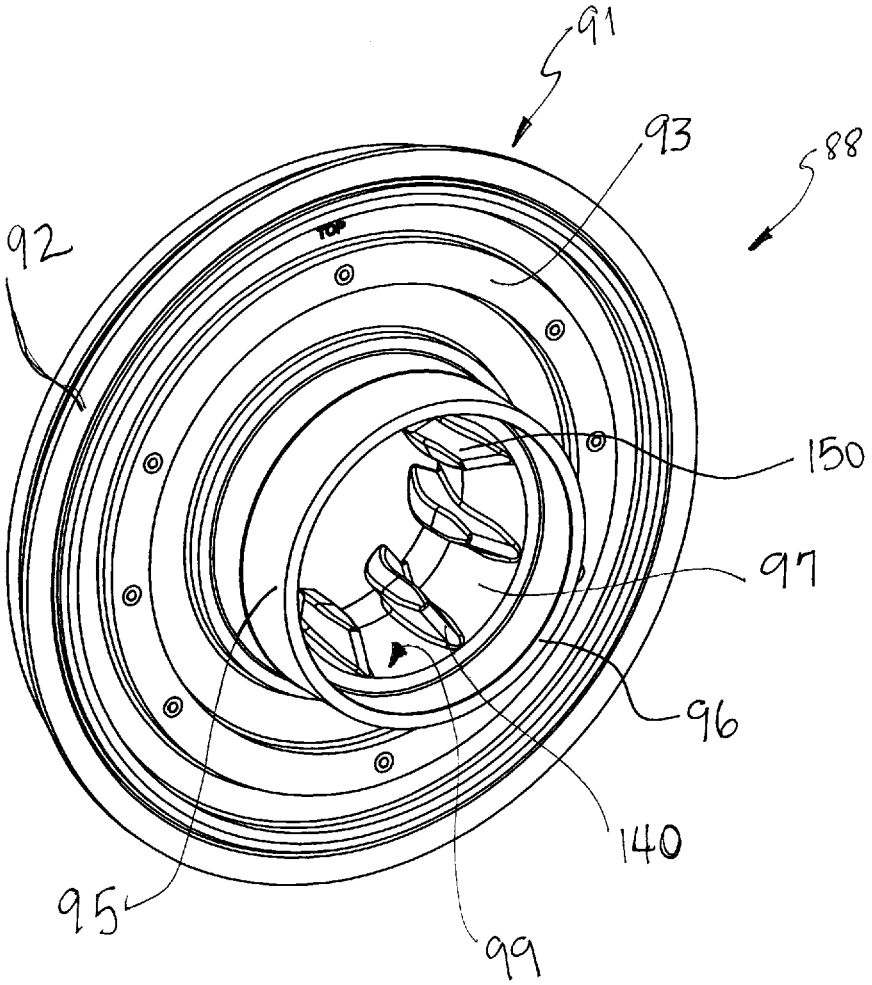
FIG. 12 is a perspective view of the embodiment of the pump intake device shown in FIG. 11.

As shown in FIG. 1, when in its normal operating position the central axis is generally horizontally disposed. In the embodiment of FIGS. 2-4, the wear member further includes two groups of guide vanes or blades 140 and 150 on the inner surface of the conduit section 108. In the embodiment illustrated each group comprises four guide vanes which are spaced around a sector of the conduit section 108. In the embodiment of FIGS. 11 and 12, the guide vanes or blades 140 and 150 are located on an inner surface 99 of the intake passage 97 of the conduit 95 of the main body 91 of the liner part 88. The guide vanes 140 (as shown in FIG. 6 and in overlay in FIG. 7) are disposed in a lower sector and comprise a main body portion 143 having side walls 145 and 146, a leading edge portion 147 with a leading edge 142 and a trailing edge portion 148 with a trailing edge 144. As shown the leading edge portion 147 tapers towards the leading edge 142 from the main body portion 143. The trailing edge portion 148 also tapers towards the trailing edge from the main body portion 143. Similarly the guide vanes 150 (as shown in FIG. 5 and in overlay in FIG. 7) are disposed in an upper sector and each comprise a main body portion 153 having side walls 155 and 156, a leading edge portion 157 with a leading edge 152 and a trailing edge portion 158 with a trailing edge 154. As shown the leading edge portion 157 tapers towards the leading edge 152 from the main body portion 153. The trailing edge portion 158 also tapers towards the trailing edge from the main body portion 153. As shown the trailing edges 144 and 154 are adjacent the exit end of the intake passage 97. The guide vanes 140 and 150 are curved and the trailing edge portion of each guide blade is disposed at an exit angle A for the guide vanes 140 and an exit angle B for the guide vanes 150. The exit angle A is greater than exit angle B for reasons which will hereinafter be explained.

Figure 8:
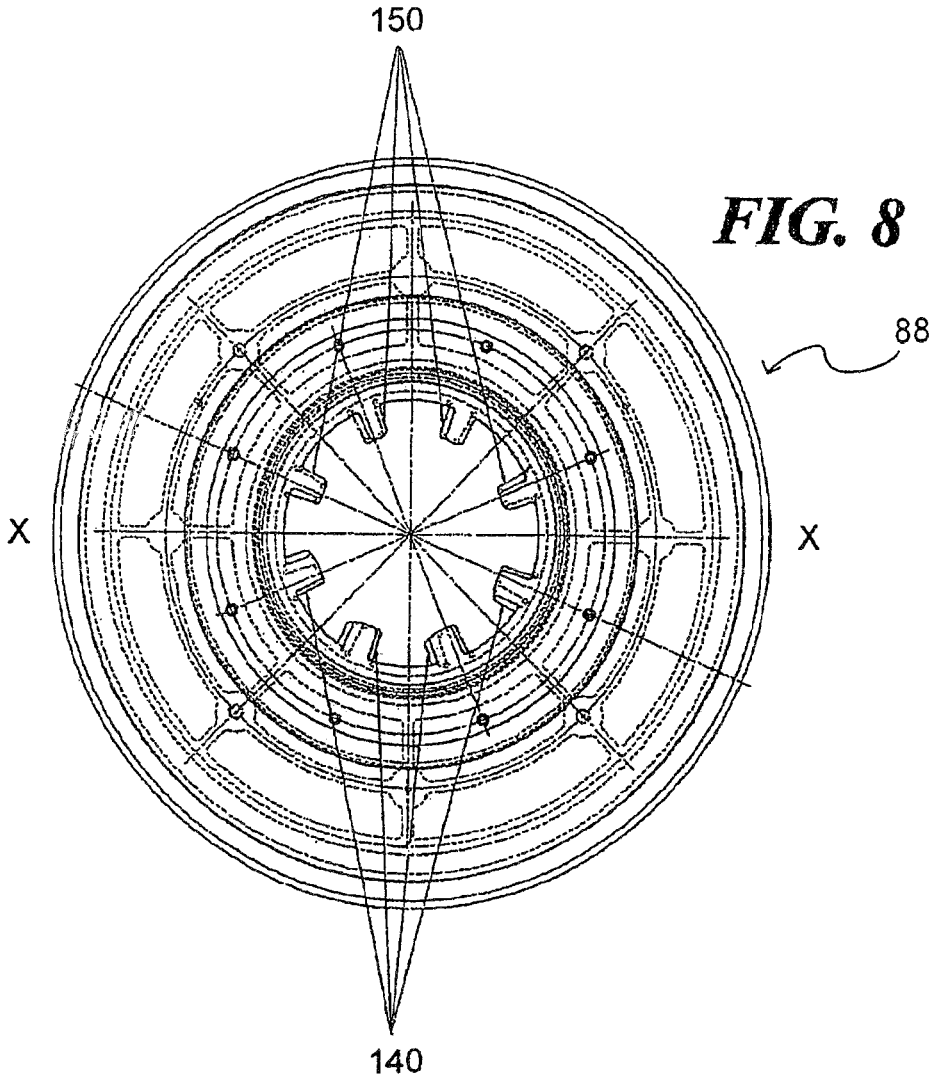
FIG. 8 is an end elevation of a pump intake device according to one embodiment.
Figure 9:
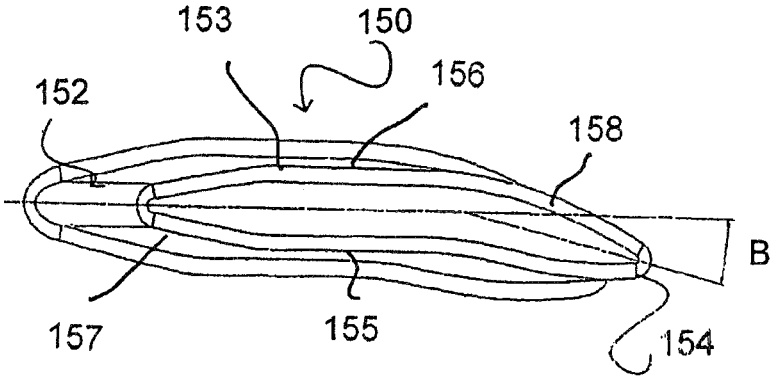
FIGS. 9 and 10 are plan views of the vanes which form part of the device shown in FIG. 8.

As best illustrated in FIGS. 8 and 9, the exit angle is the angle of divergence of the trailing edge portion from a line which extends between the leading edge portion and the trailing edge portion which is generally parallel to the sides of a main body portion of the vane. Put another way, the exit angle is the angle between a centreline which extends along the main body portion of the vane and a centreline which extends along the trailing edge portion of the vane.

In the embodiment illustrated, the wear member 90 is releasably secured to the main body 91 by means of fasteners which are in the form of threaded bolts 118. The fasteners 118 extend through apertures 121 which are located in the side wall section 92 and which threadably engage in the apertures 115.

Figure 10:
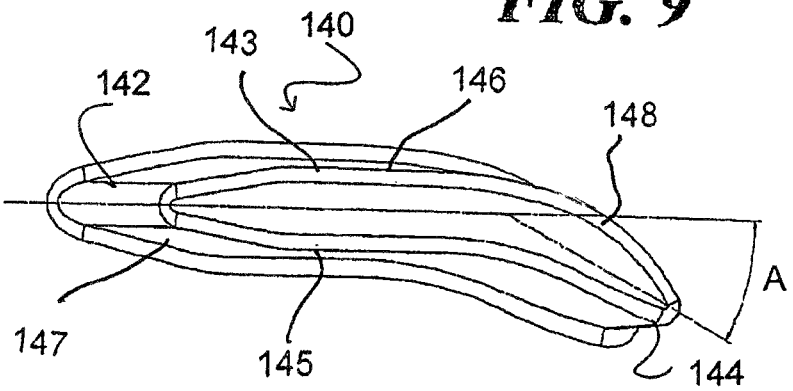

Referring to FIG. 8 which is an end elevation of a pump intake device according to one embodiment and wherein the same reference numerals used earlier have been used to identify the same parts, the orientation of the lower group of vanes 140 and the upper group of guide vanes 150 is readily seen. Both groups of vanes are substantially equispaced from one another. Both groups of vanes 140 and 150 are spaced from horizontal line X-X and the space between the adjacent upper and lower vanes is the same as the spacing between the adjacent upper vanes and adjacent lower vanes. As best seen in FIGS. 9 and 10 the vanes 140 and 150 are thickest in the central region and taper inwardly towards the leading and trailing edges.

In the embodiment shown in FIG. 8 both lower and upper groups of vanes 140 and 150 each comprise four equispaced vanes in each group. In other applications each group may contain more or less vanes than four. Furthermore one group may comprise more vanes than the other group. Furthermore the vanes in one group may be at a different spacing from the vanes in the other group. In some embodiments at least some of the vanes in one group may be at different spacings from other vanes in that group. In other embodiments the vanes in one group may extend around a larger sector than those in the other group. For example, the vanes in one group may be disposed in a region to one side of axis X-X and extend to the other side of the axis X-X. Furthermore in the embodiment shown the exit angle for the vanes in each of the groups is the same although the exit angle A for the vanes of the lower group 140 is greater then the exit angle B for the vanes in the upper group 150. It is also contemplated that at least some of the vanes in the group 140 may have different exit angles to other vanes in that group. This may also be the case for the vanes in the group 150.

In operation, slurry enters the intake passage 97 through the inlet end. The solids tend to gravitate towards the lower portion of the intake passage 97 resulting in a skewed or varied velocity in the upper and lower portions of the intake passage, as discussed earlier. The apparatus described herein aims to solve the problem of varying velocity gradient by using guide vanes set at various calculated angles around the inlet of the suction side liner. The guide vane exit angle A is greater than exit angle B so that the particulate matter of greater diameter (and weight) is directed from the throatbush towards the leading edge portion of each impeller pumping vane 83 as much as possible, so as to approach the "shockless" entry design requirement as discussed earlier. The exit angles of the guide vanes in the lower portion are configured so that that angle approaches the pumping vane inlet angle, and thereby the separation of the flow is reduced and the efficiency and wear is improved. This is not as important in the upper portion where the particulate matter is smaller and lighter.

As a result of the provision of the vanes 140 and 150 having different exit angles, this reduces the velocity gradient and improves efficiency and wear characteristics.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above", "below", "upper" and "lower", "horizontal" and "vertical" and the like are used as words of convenience to provide reference points and are not to be construed as limiting terms.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The invention claimed is:

1. A slurry pump, comprising:

a pump housing;

a pump housing inner liner arranged within the pump housing;

an impeller, having a plurality of pumping vanes, positioned within the pump housing inner liner, the impeller being connected to a drive which imparts rotation to the impeller about a rotation axis;

a pump intake device, arranged as part of the pump housing inner liner, the pump intake comprising a main body which includes a side wall section having an inner side and an outer side, an intake section extending from the outer side of the side wall section and an intake passage extending through the intake section, the intake passage having an inner surface and an entry end and an exit end with a central axis extending between the entry and exit ends, a first portion of the inner surface which includes one or more first guides thereon for directing fluid passing through the intake passage so that in use said fluid leaves the exit end at the first portion with a first exit angle which is inclined relative to the central axis, and a second portion of the inner surface of the intake passage which includes one or more second guides thereon for directing fluid passing through the intake passage so that in use said fluid leaves the exit end at the second portion with a second exit angle which is inclined relative to the central axis, the second exit angle being less than the first exit angle, the pump intake device being disposed adjacent the impeller pumping vanes.

2. A method of redistributing abrasive wear between a slurry pump impeller and an adjacent slurry pump intake device, comprising:

providing a slurry pump having an impeller and an adjacent pump intake device comprising, a main body which includes a side wall section having an inner side and an outer side, an intake section extending from the outer side of the side wall section and an intake passage extending through the intake section, the intake passage having an inner surface and an entry end and an exit end with a central axis extending between the entry end and exit end, a first portion of the inner surface which includes one or more first guides thereon for directing fluid passing through the intake passage, and a second portion of the inner surface of the intake passage which includes one or more second guides thereon for directing fluid passing through the intake passage; and introducing a pumped fluid into the pump intake device to direct fluid from the exit end at two different exit angles which are inclined relative to the central axis, one of the exit angles being less than the other.

3. A pump intake device for a centrifugal pump, comprising a main body which includes a side wall section, an intake section extending from an outer side of the side wall section and an intake passage extending through the intake section, the intake passage having an inner surface, an entry end and an exit end with a central axis extending between the entry end and exit end, a first portion of the inner surface having one or more first guides thereon which are configured to direct fluid passing through the intake passage to exit the first portion with a first exit angle which is inclined relative to the central axis, and a second portion of the inner surface of the intake passage having one or more second guides thereon configured to direct fluid passing through the intake passage to exit the second portion with a second exit angle which is inclined relative to the central axis and which is different than the first exit angle, and wherein the one or more first guides are located in opposition to the one or more second guides about the central axis that extends through the intake passage.

4. The pump intake device of claim 3, wherein the second exit angle is less than the first exit angle.

* * * * *